US006798634B2

(12) United States Patent
Hoepken

(10) Patent No.: US 6,798,634 B2
(45) Date of Patent: Sep. 28, 2004

(54) DEVICE FOR ACTUATING AN ELECTROMAGNET

(75) Inventor: Hermann Hoepken, Sprockhovel (DE)

(73) Assignee: K.A. Schmersal GmbH & Co., Wuppertal (DE)

( * ) Notice: Subject to any disclaimer, the term of this patent is extended or adjusted under 35 U.S.C. 154(b) by 114 days.

(21) Appl. No.: 10/194,449

(22) Filed: Jul. 11, 2002

(65) Prior Publication Data

US 2003/0016102 A1 Jan. 23, 2003

(30) Foreign Application Priority Data

Jul. 14, 2001 (DE) ..... 101 34 346

(51) Int. Cl.[7] ..... H01H 47/00
(52) U.S. Cl. ..... 361/152; 361/154; 361/160
(58) Field of Search ..... 361/154–156, 361/160, 166, 153, 599, 561, 567, 811

(56) References Cited

U.S. PATENT DOCUMENTS 4,720,763 A * 1/1988 Bauer ..... 361/154
4,743,821 A * 5/1988 Hall ..... 318/599
5,481,187 A * 1/1996 Marcott et al. ..... 324/207.16
6,208,497 B1 * 3/2001 Seale et al. ..... 361/160

FOREIGN PATENT DOCUMENTS

DE 3733091 9/1987 ..... H01F/7/18
DE 19641188 9/1996 ..... H01H/47/22
DE 19647215 11/1996 ..... H01F/7/18

* cited by examiner

*Primary Examiner*—Anthony Dinkins
(74) *Attorney, Agent, or Firm*—Patterson, Thuente, Skaar & Christensen, P.A.

(57) ABSTRACT

A device with a safety circuit with an armature activated by a solenoid activates an electromagnet. The device has a switch connected in series to the solenoid, a device temporarily interrupting application of the voltage, first and second clock generators, first and second resistors, and a current detection switch. DC voltage is applied to the solenoid when the switch is closed. The voltage is interrupted when a predetermined current flowing through the solenoid is detected. The first clock generator actuates the switch during a predetermined first clock cycle. The detection switch detects current flowing through the solenoid. The first resistor, in conjunction with the response threshold of the current detection switch, determines the holding current for the armature. The second resistor generates an attraction current for the armature when activated by the second clock generator in a predetermined second clock cycle partially overlapping the first clock cycle.

20 Claims, 3 Drawing Sheets

DEVICE FOR ACTUATING AN ELECTROMAGNET

FIELD OF THE INVENTION

The invention relates to a device for actuating an electromagnet as it used in safety or security circuits which themselves are used in connection with safety switches for surveying the open and closed positions of doors, flaps or the like of restricted areas in production lines or the like.

In such safety or security circuits for locking and unlocking doors, flaps or the like, electromagnets are used which have an armature which can be activated in accordance with the actuation of a solenoid and which, on the basis of its position, locks or unlocks a door. It must be ensured here that the armature moves correctly during a pull-in section and that a magnetic force which is exerted by the solenoid for holding the armature in its position during a holding section when there is the lowest possible operating voltage applied is not reduced to such an extent that the armature drops out as a result of external faults, in particular vibrations.

A predetermined application of voltage to the solenoid does not, however, allow for the current flowing through the solenoid to be monitored in terms of an energy loss or the operating temperature of the solenoid so that it is advantageous to interrupt the application of voltage when the solenoid heats up and/or when specific current values are reached, in order to prevent energy loss through a generation of heat by the solenoid.

BACKGROUND OF THE INVENTION

Published German Patent Application No. DE 43 41 797 A1 discloses that a current flowing through an electromagnet load, for example in the form of a solenoid, is limited by a current regulating means to a predetermined value which is higher in an pull-in section than in a holding section. For this purpose, a switch is used with which the solenoid can be temporarily disconnected from the voltage applied to it if the respective current value is reached. The switch is closed again if a respective low current value is reached. In order to determine the current flowing through the solenoid, the device uses a measuring device which is connected to a current evaluation means. The current measured by the current evaluation means is compared with a maximum current by a current regulator, the current regulator generating an actuation signal which is applied to an output stage which itself actuates the switch. This is costly owing to the use of numerous different components and has, in particular with the current evaluation means and the output stage, multi-component parts.

German Patent No. DE 195 22 582 C2 discloses that, to actuate an electromagnet which activates an armature, a voltage is applied to a solenoid with a predetermined periodicity. A period has sections of time with different lengths. It is possible to distinguish between pull-in sections and relatively long holding sections, the pull-in sections having essentially a long pulse and the holding sections having a plurality of shorter pulses for applying voltage to the solenoid. The pull-in sections serve the purpose of pulling in the solenoid, a larger current being present at the end of an pull-in section—owing to the longer pulses in comparison with the pulses during the holding sections—than flows through the solenoid at the end of a pulse of the holding sections. The holding sections have the purpose of maintaining a relatively small current which flows through the solenoid and which is sufficient to hold the armature in its position.

SUMMARY OF THE INVENTION

It is an object of the invention to provide a device for actuating an electromagnet which uses simple components and is of simple design.

The invention concerns a device for actuating an electromagnet, in particular for a safety circuit, which has an armature which is activated in accordance with the actuation of a solenoid; comprising

- a switch which is connected in series to the solenoid and via which a d.c. voltage is applicable to the solenoid by closing the switch;
- a device for temporarily interrupting the application of the voltage as long as a predetermined current flowing through the solenoid is detected;
- a first clock generator for actuating the switch in a predetermined first clock cycle;
- a first and a second resistor, which are each connected in series to the solenoid and in parallel with one another;
- a current detection switch, connected in series to the switch, for detecting the current flowing through the solenoid;
- wherein the magnitude of the first resistor which is connected in parallel with the current detection switch determining, in conjunction with the response threshold of the current detection switch, the magnitude of the holding current for the armature; and
- wherein the second resistor is connectable into the circuit for generating an attraction current for the armature, via a further, second clock generator in a predetermined second clock cycle, which at least partially overlaps with the first clock cycle.

The device for actuating an electromagnet is provided in which a d.c. voltage applicable to a solenoid periodically in the clock cycle by means of clocked closing of a switch, it being possible to interrupt the application of the d.c. voltage when a predetermined current value is reached, by means of a current detection switch through which a partial current flowing through the solenoid flows as a function of a first resistor which is connected in parallel with the current detector switch and in series with the solenoid. A different maximum current in pull-in sections and holding sections is achieved here by virtue of the fact that, in a second clock cycle, which overlaps at least with the first clock cycle, a second resistor can be connected into the circuit in parallel with the first resistor in order to generate an attraction current. In this case, a relatively high current can flow through the solenoid as, as a result of the connection into the circuit of the second resistor, the magnitude of the resulting relatively small overall resistance determines the magnitude of the current flowing through the solenoid. As a result, a very simple design can be achieved using simple components.

Further objects, advantages and embodiments of the invention can be found in the following description.

BRIEF DESCRIPTION OF THE DRAWINGS

The invention will be explained in more detail below with reference to an exemplary embodiment illustrated in the appended figures.

DETAILED DESCRIPTION OF THE PREFERRED EMBODIMENT

Figure 1:
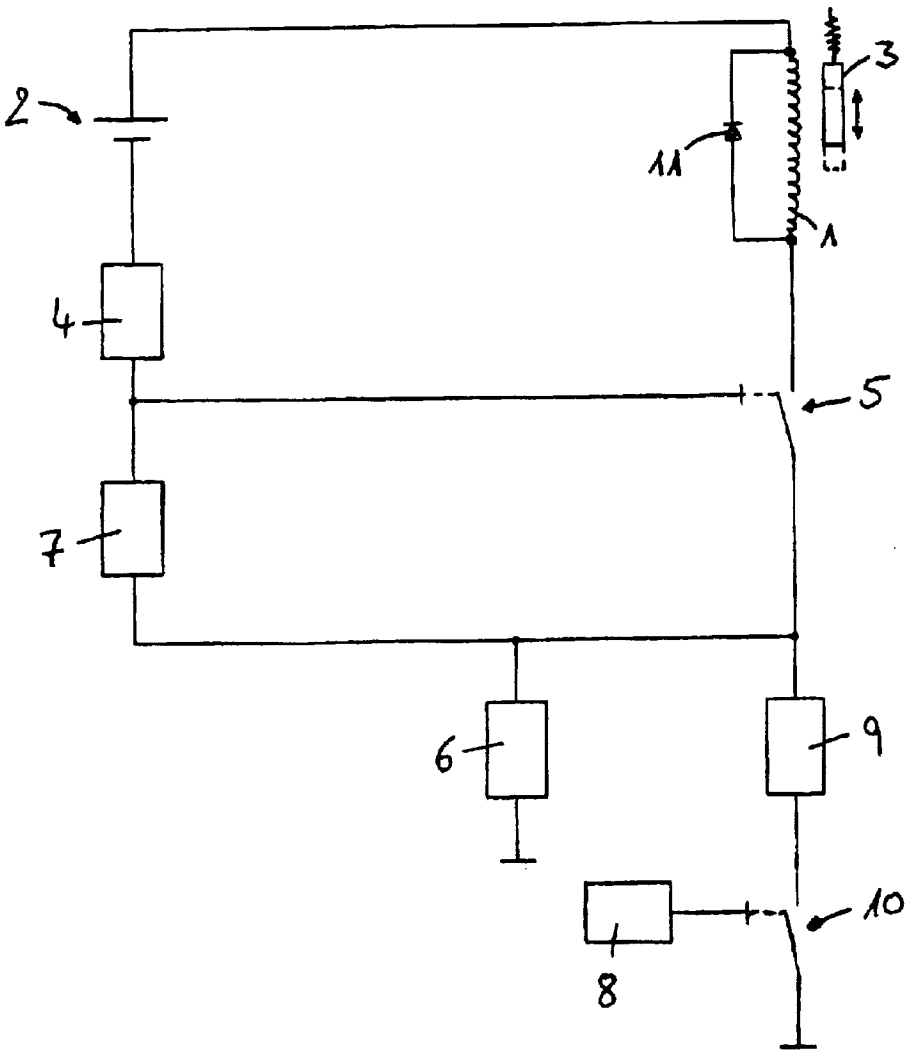
FIG. 1 shows a simplified and schematic view of a circuit diagram of an embodiment of a circuit for actuating an electromagnet.

The circuit according to FIG. 1 has an electromagnet with a solenoid 1 which can have a d.c. voltage of a voltage source 2 applied to it and serves the purpose of activating an associated spring-loaded armature 3. A clock generator 4 which is connected to the voltage source 2 is connected to a switch 5 which is connected in series with the solenoid 1, as a result of which the switch 5 is closed and opened in accordance in time with of the clock generator 4. In the closed state of the switch 5, the d.c. voltage of the voltage source 2 is applied to the solenoid 1.

A first resistor 6, which is connected to earth, is connected in series with the switch 5, a voltage drop taking place across said resistor 6 if the switch 5 is closed and the d.c. voltage is applied to the solenoid 1.

In order to temporarily interrupt the application of voltage to the solenoid 1, a device which comprises a current detection switch 7 is provided. The current detection switch 7 is connected in parallel with the first resistor 6 and in series with the switch 5 and temporarily switches off the voltage source 2 of the solenoid 1 by opening the switch 5 as long as a predetermined current flowing through the solenoid 1 is detected by the current detection switch 7. If the detected current drops away again, the current detection switch 7 terminates ist influence on the switch 5 and the latter is activated again by the clock generator 4. The current flowing through the solenoid 1 is thus limited by the switching of the current detection switch 7, the current flowing through the first resistor 6 being sensed by the current detection switch 7. The magnitude of the first resistor 6 is selected here in conjunction with the current detection switch 7 in such a way that a current which is sufficient to keep the armature 3 in ist position—there is therefore a holding current flowing—can flow through the solenoid 1.

A further, second resistor 9 can be connected into the circuit in parallel with the first resistor 6 by means of a switch 10, using a further clock generator 8 whose clock at least overlaps partially with the clock generator 4 and is lower than it, the second resistor 9 being connected to earth. The magnitude of the second resistor 9 is selected such that a relatively small overall resistance is obtained. The magnitude of the first resistor 6 is preferably greater than that of the second resistor 9. If the switch 10 is closed and the second resistor 9 is connected into the circuit, a higher current can flow through the solenoid 1 as the current flows away to a greater degree via the resulting smaller overall resistance without the response threshold of the current detection switch 7 being reached and said current detection switch 7 switching. In this way, the clocked connection of the second resistor 9 into the circuit when the switch 5 is closed permits a higher current than the holding current, namely an attraction current, to flow through the solenoid 1. When the response threshold at the current detection switch 7 is reached, the application of voltage to the solenoid 1 is also in this case temporarily interrupted via the current detection switch 7.

A recovery circuit is preferably provided for the solenoid 1, said recovery circuit comprising a recovery diode 11 which is connected in parallel with the solenoid 1. The current through the solenoid 1 is maintained for a time which is specified by the inductance of the solenoid 1, when the switch 5 is open, and said current is short-circuited by the recovery diode 11. In the process, the recovery circuit can, if appropriate, comprise a series circuit composed of further diodes and/or transistors.

Figure 2:
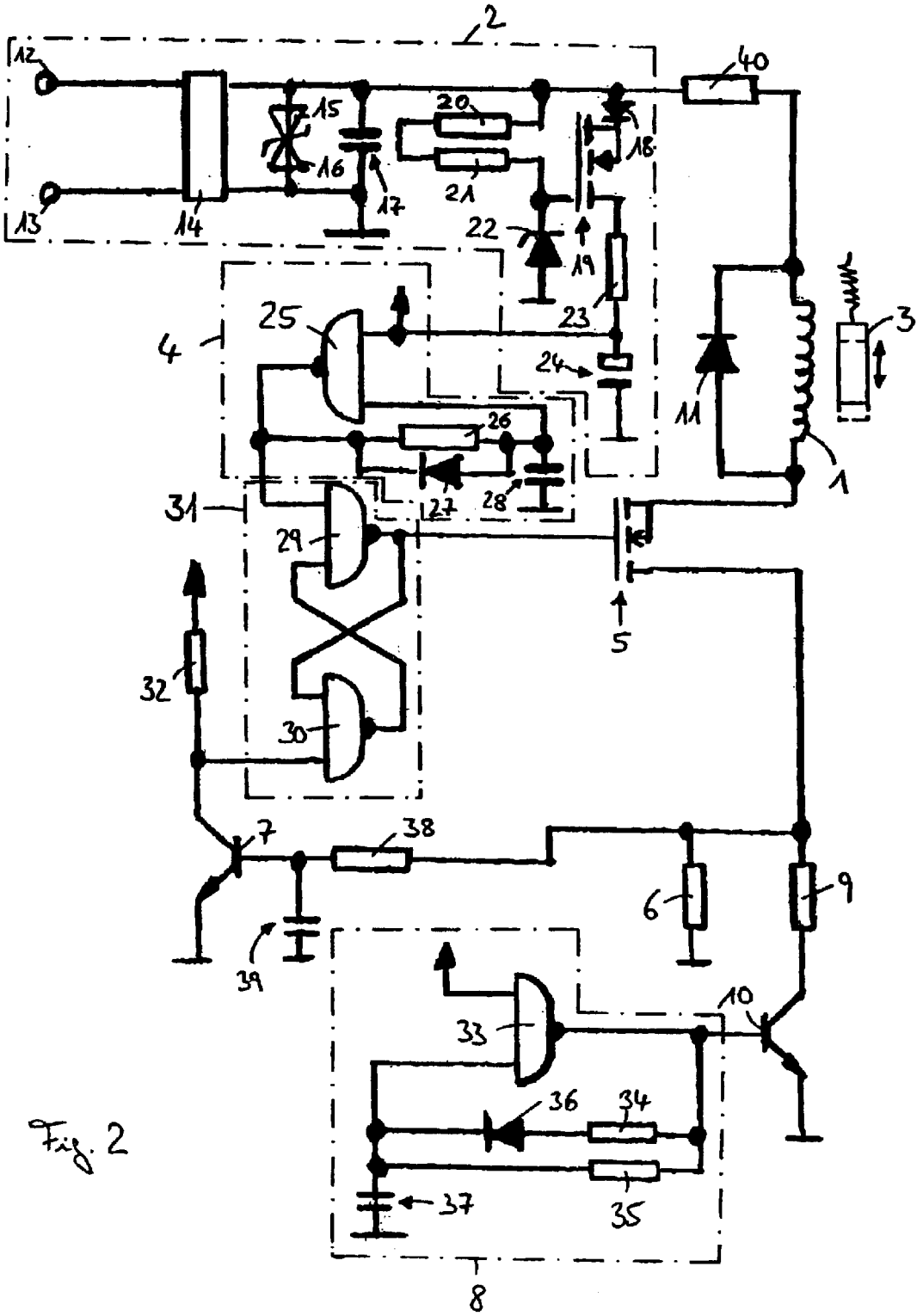
FIG. 2 shows an example of a detailed circuit diagram of the embodiment in FIG. 1.

According to FIG. 2, the voltage source 2 is configured as a d.c. voltage regulating device for an a.c. operating voltage connected via the terminals 12, 13. In the d.c. voltage regulating device a rectifier 14 is provided to which two zener diodes 15, 16 connected to one another in opposite directions and a capacitor 17 are connected in parallel. The capacitor 17 is connected in series to earth here. The d.c. voltage regulating device also comprises a diode 18 which is connected to the capacitor 17 and which is followed by a field-effect transistor 19. The field-effect transistor 19 is connected by means of two resistors 20, 21 which are connected in series with one another and in series with the capacitor 17, a limiter diode 22 which is connected to earth being provided between the two resistors 20, 21 and the field-effect transistor 19. In the closed state, the field-effect transistor 19 connects into the circuit of the d.c. voltage regulating device a resistor 23 and a capacitor 24, connected to earth, as filter.

The clock generator 4 for the clocked closing of the switch 5 which is embodied in this exemplary embodiment as a field-effect transistor comprises a clock generator NAND gate 25, of which one input is connected to the voltage source 2 for the supply of power and also has a high level applied to it. The output of the clock generator NAND gate 25 is fed back to the other input of the clock generator NAND gate 25 via a circuit combination comprising an ohmic clock generator resistor 26, a clock generator diode 27 and a clock generator capacitor 28. As a result of the circuit combination of the clock generator resistor 26, the clock generator diode 27 and the clock generator capacitor 28, a constant, clocked time behaviour of the output signal of the clock generator NAND gate 25 is achieved, the charging of the clock generator capacitor 28 taking place more slowly than the discharging.

The output of the clock generator 4 is also connected to a SET input of a flip-flop 31 comprising two NAND gates 29, 30, said flip-flop 31 opening or closing the switch 5 in clocked fashion by means of the signal at the Q output on the basis of the signal of the clock generator 4 which is present at the SET input.

The current detection switch 7 is embodied as a transistor whose base-emitter path picks up the voltage in the circuit. The emitter of the transistor is connected to earth, and the collector is connected both to high potential via an resistor 32 and to a RESET input of the flip-flop 31. The transistor which is connected in parallel with the resistor 6 and in series with the solenoid 1 switches on when the voltage at the resistor 6 exceeds the voltage between the base and the emitter of the transistor. The signal present at the RESET input of the flip-flop 31 then changes as the current flowing via the resistor 32 flows away to earth via the current detection switch 7. The flip-flop 31 then opens the switch 5, and the application of the d.c. voltage to the solenoid 1 is temporarily interrupted.

If the voltage across the transistor used as current detection switch 7 drops away again, the transistor switches off and the signal at the RESET input of the flip-flop 31 changes again so that the switch 5 is switched again in accordance in time with of the clock generator 4.

The clocked connection of the resistor 9 takes place in time with the further clock generator 8 which comprises a clock generator NAND gate 33. The output of the clock generator NAND gate 33 is fed back again to an input of the clock generator NAND gate 33 via a circuit combination comprising two parallel ohmic clock generator resistors 33, 35, a clock generator diode 36 and a clock generator capacitor 37, it being possible for positive voltage to be applied to a further input of the clock generator NAND gate 33. As a result of the circuit combination comprising the clock generator resistors 34, 35, the clock generator diode 36 and the clock generator capacitor 37, a constant, clocked time behaviour is achieved, the clock of the clock generator 8 being lower than the clock of the clock generator 4. Here, the clock generator capacitor 37 is discharged more slowly than it is charged if, for example, the magnitude of the resistor 35 corresponds to ten times the resistor 34, the value of the resistor 34 being for example 1 MΩ, and the value of the resistor 35 being, for example, 10 MΩ. The switch 10 which is configured as a transistor and which connects the resistor 9 into the circuit in parallel with the first resistor 6 in time with the second clock generator 8 and connects it to earth is switched by the clock generator 8.

The further clock generator 8 is activated, for example by means of an appropriate controller, via the clock generator NAND gate 33 at the start of actuation of the electromagnet to attract the armature 3, while after the attraction of the armature 3 only the clock generator 4 is active. However, the further clock generator 8 can also be permanently connected so that pull-in and holding sections alternate.

A peak filter resistor 38 and a peak filter capacitor 39 are provided upstream of the current detection circuit 7 in order to filter voltage peaks.

A filter 40, which can comprise an inductor and/or a ferrite core, is provided in the circuit between the solenoid 1 and the voltage source 2.

Figure 3:
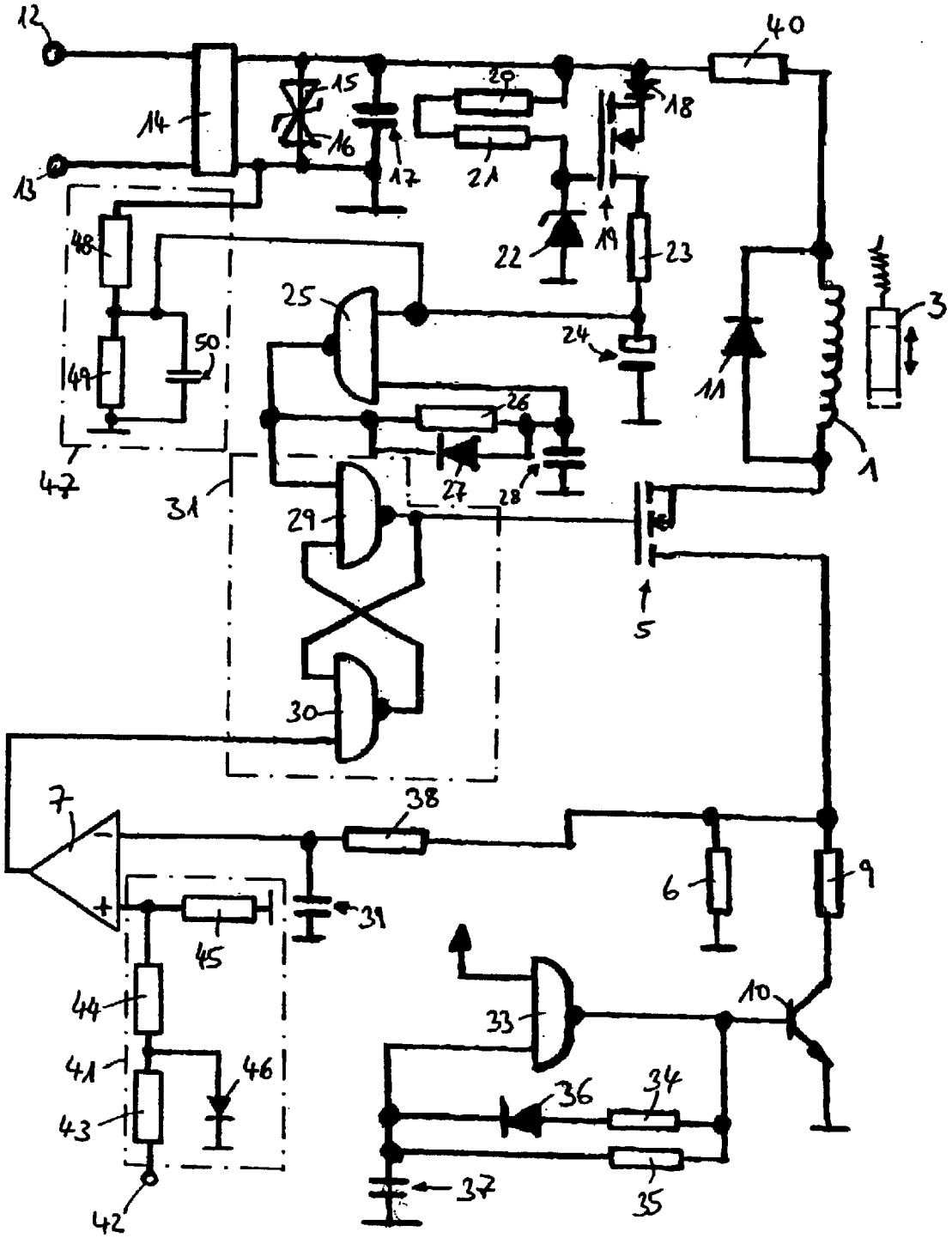
FIG. 3 shows an example of a detailed circuit diagram of a further embodiment of FIG. 1.

As shown in the further embodiment illustrated in FIG. 3, the current detection switch 7 can also be embodied as an inverting comparator whose output is connected to the RESET input of the flip-flop 31. A first input of the two inputs of the comparator is connected in series with the resistor 6 and picks up the voltage in the circuit. The other, second input of the comparator has a comparison voltage applied to it whose value is set by a voltage divider 41 which is connected between a terminal 42 which supplies the rectified a.c. operating voltage and the second input of the comparator. The voltage divider 41 comprises three resistors 43, 44, 45 which are connected in series, of which the resistor 45 is connected to earth. The second input of the comparator is connected to a node which is located between the resistor 44 and the resistor 45. A node which lies between the resistor 43 and the resistor 44 is connected to earth via a diode 46 which is connected in the conducting direction.

The comparator supplies a high level to the RESET input of the flip-flop 31 as long as the voltage recorded at the first input does not exceed the predetermined comparison voltage value present at the second input. If the sensed voltage is higher, the comparator supplies a low level to the RESET input of the flip-flop 31 and the switch 5 is opened by the flip-flop 31. If the sensed voltage drops below the predetermined comparison voltage value, the comparator supplies a high level to the RESET input of the flip-flop 31, and the switch 5 is opened and closed again in time with the clock generator 4.

Furthermore, as shown in FIG. 3, in the illustrated embodiments a voltage divider device 47 which is connected between the rectifier 14 and the clock generator NAND gate 25 may be provided. Said voltage divider device 47 comprises two ohmic voltage divider resistors 48, 49 which are connected in series, of which the voltage divider resistor 49 is earthed, and a capacitor 50 which is connected in parallel with the voltage divider resistor 49. The application of voltage to the one input of the one clock generator NAND gate 25 in order to clock the clock generator 4 is carried out via the voltage divider device 47, the clocking having to be carried out in accordance with a predefined condition if the a.c. operating voltage is over 80% of ist rated voltage and is interrupted if the a.c. operating voltage drops below 20% of ist rated voltage. This allows for a residual current which is present despite the voltage source being switched off, ensuring that despite this residual current the clocking and therefore pulling in of the solenoid 1 is prevented for values below 20% of the rated voltage. For this purpose, the voltage divider resistor 48 is matched to the a.c. operating voltage present at the terminals 12,13 in conjunction with the voltage divider resistor 49 such that when a particular percentage of the a.c. operating voltage, which is above 20% and less than 80% of the a.c. operating voltage, is present, the upper trigger threshold of the clock generator NAND gate 25 which is connected to the voltage divider resistor 48 is exceeded and the clocking begins so that the clocking is carried out at the latest at 80% of the rated voltage. As the clock generator NAND gate 25 has a hysteresis owing to Schmitt triggers at the inputs, the clocking is maintained even when the voltage drops below the value of the upper trigger threshold and it is interrupted only if the voltage drops below the lower threshold of the Schmitt trigger of the input. In this way, the ratio of the two resistance values of the voltage divider resistors 48, 49 and the aforesaid hysteresis are used to define a voltage value starting from which the clocking is carried out, it being further ensured that the clocking is interrupted when the voltage drops below 20% of the rated voltage.

The capacitor 50 connected in parallel with the voltage divider resistor 49 bridges the zero crossover point here during a.c. operation.

While the invention has been shown and described with reference to preferred embodiments, it should be apparent to one of ordinary skill in the art that many changes and modifications may be made without departing from the spirit and scope of the invention as defined in the claims.

What is claimed is:

1. A device for actuating an electromagnet, in particular for a safety circuit, which has an armature which is activated in accordance with the actuation of a solenoid; comprising a switch which is connected in series to the solenoid and via which a d.c. voltage is applicable to the solenoid by closing the switch;

a device for temporarily interrupting the application of the voltage as long as a predetermined current flowing through the solenoid is detected;

a first clock generator for actuating the switch in a predetermined first clock cycle;

a first and a second resistor, which are each connected in series to the solenoid and in parallel with one another;

a current detection switch, connected in series to the switch, for detecting the current flowing through the solenoid;

wherein the magnitude of the first resistor which is connected in parallel with the current detection switch determining, in conjunction with the response threshold of the current detection switch, the magnitude of the holding current for the armature; and wherein the second resistor is connectable into the circuit for generating an attraction current for the armature, via a further, second clock generator in a predetermined second clock cycle, which at least partially overlaps with the first clock cycle.

2. The device according to claim 1, wherein the first resistor is larger than the second resistor.

3. The device according to claim 1, wherein a recovery circuit, comprising a recovery diode, is provided for the solenoid.

4. The device according to claim 1, wherein the clock cycle of the first clock generator is higher than that of the second clock generator.

5. The device according to claim 1, wherein the clock generator has an upper and a lower input trigger threshold for actuating or terminating the clocking, and is connected to a node which is located between two ohmic voltage divider resistors which are connected in series, one voltage divider resistor of which being connected to an operating voltage, and the other voltage divider resistor being connected to earth, the ratio between the two values of the voltage divider resistors determining the start and the end of the clocking with respect to the operating voltage and the upper and lower input trigger threshold.

6. The device according to claim 5, wherein the operating voltage is a rectified a.c. voltage, and a capacitor is connected in parallel with the other voltage divider resistor.

7. The device according to claim 1, wherein the first resistor is connected to earth.

8. The device according to claim 1, wherein the second resistor can be connected to earth via a further switch which is actuated by the second clock generator.

9. The device according to claim 8, wherein the further switch is a transistor.

10. The device according to claim 1, wherein the switch is a transistor, preferably a field-effect transistor.

11. The device according to claim 1, wherein the current detection switch is a transistor, it being possible to record the current which is to be detected by means of the base-emitter voltage of said transistor.

12. The device according to claim 1, wherein the current detection switch is a comparator.

13. The device according to claim 1, wherein in order to temporarily interrupt the application of the voltage it is possible to open the switch by means of the current detection switch.

14. The device according to claim 13, wherein the output of the first clock generator is connected to the SET input of a flip-flop, and the current detection switch is connected to the RESET input of the flip-flop, the Q output of the flip-flop being connected to the switch.

15. The device according to claim 14, wherein the flip-flop comprises two NAND gates.

16. The device according to 1, wherein the first clock generator comprises a clock generator NAND gate whose output is fed back to one of the two inputs via a circuit combination comprising a clock generator resistor, a clock generator diode and a clock generator capacitor, the clock of the output of the clock generator NAND gate being predetermined with a time constant which can be selected essentially by the clock generator resistor and the clock generator capacitor.

17. The device according to claim 16, wherein the other of the two inputs of the clock generator NAND gate is at a constant high level.

18. The device according to claim 16, wherein the other of the two inputs of the clock generator NAND gate is connected to a node which is located between two ohmic voltage divider resistors which are connected in series, one voltage divider resistor being connected to an operating voltage, and the other voltage divider resistor being connected to earth, the start and the end of the clocking being adjustable in relation to the operating voltage and the upper or lower trigger threshold of the clock generator NAND gate by means of the ratio between the two values of the voltage divider resistors.

19. The device according to claim 18, wherein the operating voltage is a rectified a.c. voltage, and a capacitor is connected in parallel with the other voltage divider resistor.

20. The device according to claim 1, wherein the second clock generator comprises a clock generator NAND gate whose output is fed back to an input of the clock generator NAND gate via a circuit combination comprising two ohmic clock generator resistors, a clock generator diode and a clock generator capacitor.

* * * * *